US005934487A

United States Patent [19]

Hoeg

[11] Patent Number: 5,934,487

[45] Date of Patent: Aug. 10, 1999

[54] DATA DOCUMENT HANDLING APPARATUS

[76] Inventor: Dianne E. Hoeg, 10 Cantebury Dr., Carver, Mass. 02330

[21] Appl. No.: 09/041,510

[22] Filed: Mar. 12, 1998

Related U.S. Application Data

[60] Provisional application No. 60/040,528, Mar. 14, 1997.

[51] Int. Cl.[6] ..... A47F 5/00

[52] U.S. Cl. ..... 211/50; 211/13.1; 248/176.1; 248/918; 248/174

[58] Field of Search ..... 211/50, 13.1; 248/176.1, 248/174, 918, 441.1

[56] References Cited

U.S. PATENT DOCUMENTS

| | | | |
|---|---|---|---|
| 1,659,509 | 2/1928 | Ashbrook | 211/50 |
| 2,789,700 | 4/1957 | King et al. | 211/50 X |
| 3,447,677 | 6/1969 | Aitkens | 211/50 X |
| 3,746,296 | 7/1973 | Dean et al. | 211/50 X |
| 4,163,497 | 8/1979 | McEwen | 248/441.1 X |
| 5,080,316 | 1/1992 | MacEwan | 248/174 X |
| 5,106,047 | 4/1992 | Baer | 248/174 X |
| 5,358,208 | 10/1994 | Moseley et al. | 248/918 X |
| 5,411,145 | 5/1995 | Parks | 211/50 |
| 5,810,182 | 9/1998 | Levin | 211/50 X |

*Primary Examiner*—Robert W. Gibson, Jr.
*Attorney, Agent, or Firm*—Richard P. Crowley

[57] ABSTRACT

A data document handling or processing apparatus with a plurality of continuous, angular top surfaces to hold checks to be processed and an open side for the insertion of a computer keyboard to expose the numerical keyboard section for use.

7 Claims, 4 Drawing Sheets

DATA DOCUMENT HANDLING APPARATUS

REFERENCE TO PRIOR APPLICATION

This application incorporates by reference and claims the benefit of U.S. Provisional Application Ser. No. 60/040,528, filed Mar. 14, 1997.

BACKGROUND OF THE INVENTION

In the processing of data type documents, such as checks processed in a banking system, the information on the front and back of the check is entered into a computer via a keyboard having alpha and numerical sections, and the information is displayed on a monitor and/or printed art. For example, bundles of checks to be processed and returned to the bank of issue are placed on a surface and the check information typically, e.g., numerical data on the front and back, is entered at a computer terminal station. This process can be time consuming and tedious, since a terminal user must look up and down, repeatedly from the check, to the keyboard, to the computer monitor, creating a physical strain on the user, while also the distance of the checks and the need to turn over the checks makes the process subject to data entry errors.

It is desirable to provide an apparatus system and method to improve data entry at a computer terminal from data documents, particularly where there are multiple data documents and the data to be entered and verified is on both sides of the documents.

SUMMARY OF THE INVENTION

The invention relates to a data document handling apparatus, system and method. The data document handling apparatus provides an angular surface platform apparatus, so that the data documents are raised above desk level to a more comfortable eye level for processing. The apparatus also permits the use of a computer keyboard directly under and adjacent the surface platform in use, and also may provide a storage area for the keyboard under the surface platform when the keyboard is not in use. The surface platform is angularly designed so that data documents, like bundles of checks to be processed, may be placed on an angular surface for reading or confirmation of previous data entry, and easily turned over sequentially to an adjoining angular surface for reading or confirmation of previous data entry.

In particular, the data document handling apparatus comprises an upper platform surface in a generally W-shape when viewed from the side and an open side on at least one side, generally both sides, to permit the movement of the keyboard thereunder. The flat surface sides of the W may vary in width and length to accommodate the data document to be handled. The surface platform is vertically spaced apart for the desk top surface, so that a keyboard may be accommodated by movement to either side of the apparatus (and beneath for storage in nonuse). The W-surface platform permits bundles of documents, like checks, to be placed on one surface for viewing of the data on one face and then easily turned over from front to back, or back to front, to another angular surface in the adjacent V-section of the W-shape to view the data information on the apparatus surface. The two V-sections of the W surface are spaced apart sufficiently in width to permit a plurality of documents on one surface from blocking documents on the adjacent V surface.

The standard keyboard, with a numerical section to the right and alpha section to the left, is typically disposed beneath the surface of the data document platform and, in use, extended slightly out to one (right) side to permit use only of the numerical section of the keyboard, while the remaining section of the keyboard is beneath, at least partially, the platform surface. Of course, the keyboard can be positioned to the left to permit use of the alphabet section of the keyboard when desired, or placed in front of the data handling apparatus to permit use of the entire keyboard.

In one embodiment, the data handling apparatus may be easily manufactured by injection-molding or thermoforming a rigid plastic sheet material, like a clear acrylic resin into a generally U-shape, with an open front and open sides and with a rear wall of the U-shape, and with a plurality of angular surfaces, such as a W-shape, to form a platform to hold the documents.

The system comprises the data document handling apparatus, with the W-shape surface platform for the documents and an open space beneath the platform; open to one side which is the right side. A standard computer keyboard adapted to move between a use position on one or the other side, optimally on the front of the apparatus, and optimally a nonuse storage position beneath the platform; and a computer monitor screen to display the data to be entered or verified.

The apparatus, system and method provides less eye strain on a user for a faster, more efficient and accurate data entry and data confirmation.

The invention will be described in connection with the processing of checks with data entry information on both front and back; however, it is recognized that the invention may be usefully employed with other data-containing documents and their processing portability where multiple documents and particularly numerical data entry or verification from the documents in a computer system is required.

The method comprises placing a plurality of data documents, like checks, on an angular surface of a V-section of a W-shaped surface platform; employing a standard keyboard beneath the surface platform and positioned to one side, which is the numerical side of the keyboard, adapted to be stored in an open space beneath the platform to enter or verify data from one surface of the document; with information on a monitor screen, turning the document over from front to rear or rear to front and onto another adjoining, continuous surface of the apparatus V-section of the platform, and employing the alphanumeric section of the keyboard to enter or verify the data on the opposite surface of the document with information on a monitor screen repeating this procedure.

DESCRIPTION OF THE EMBODIMENTS

Figure 1:
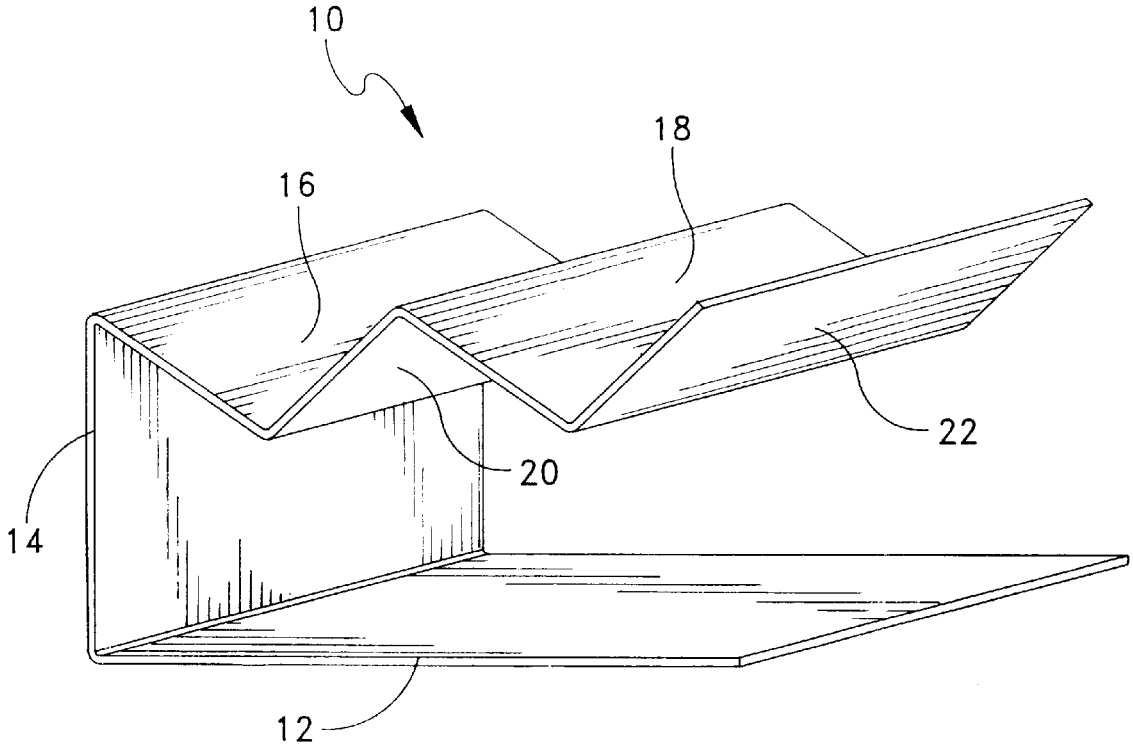
FIG. 1 is a prospective view from above the data handling apparatus.
Figure 2:
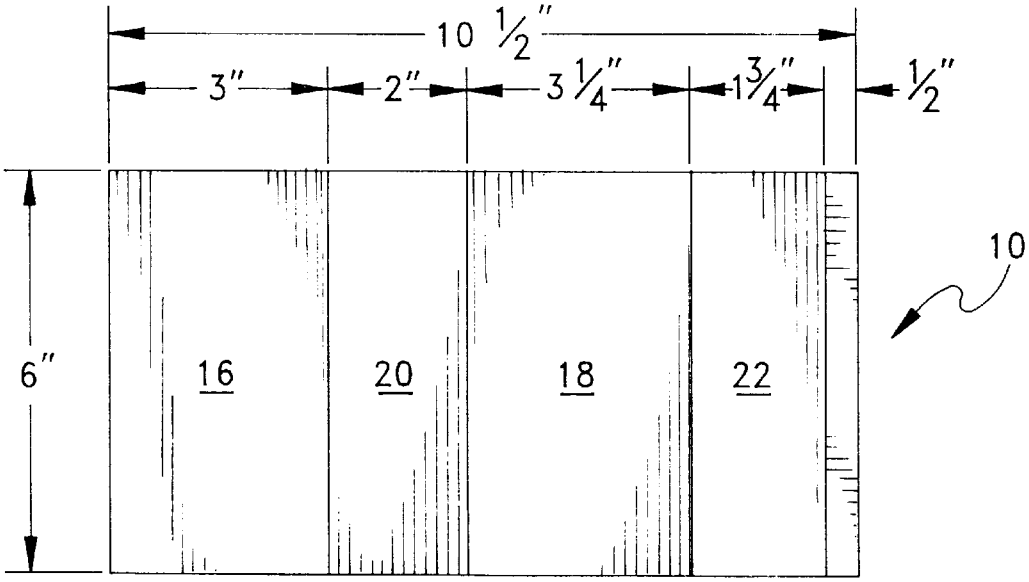
FIG. 2 is a plan top view of FIG. 1.
Figure 3:
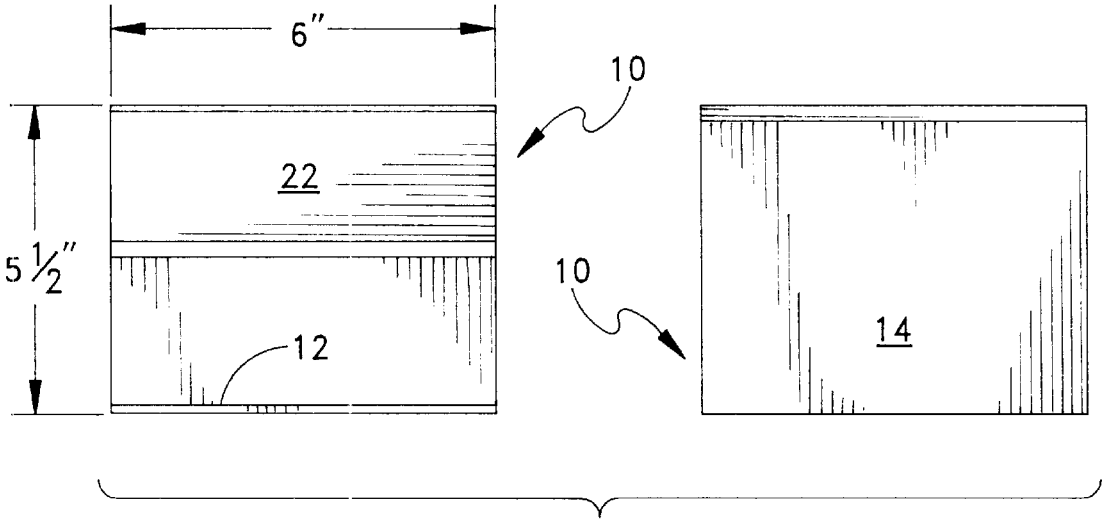
FIG. 3 is a plan front and rear view of FIG. 1.
Figure 4:
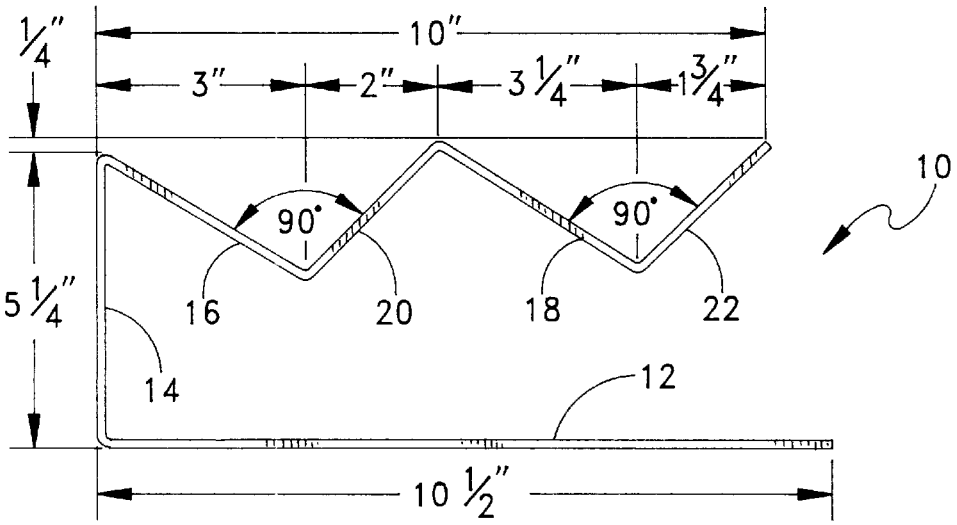
FIG. 4 is a side plan view of FIG. 1.
Figure 5:
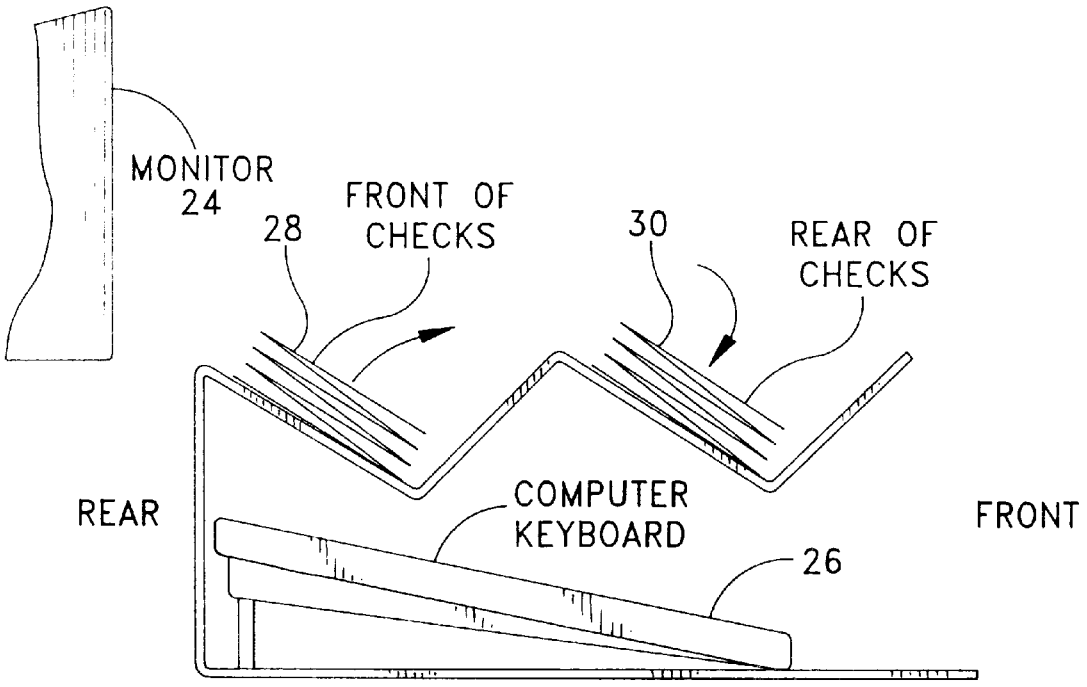
FIG. 5 is a side view of the system with the apparatus of FIG. 1 in use.
Figure 6:
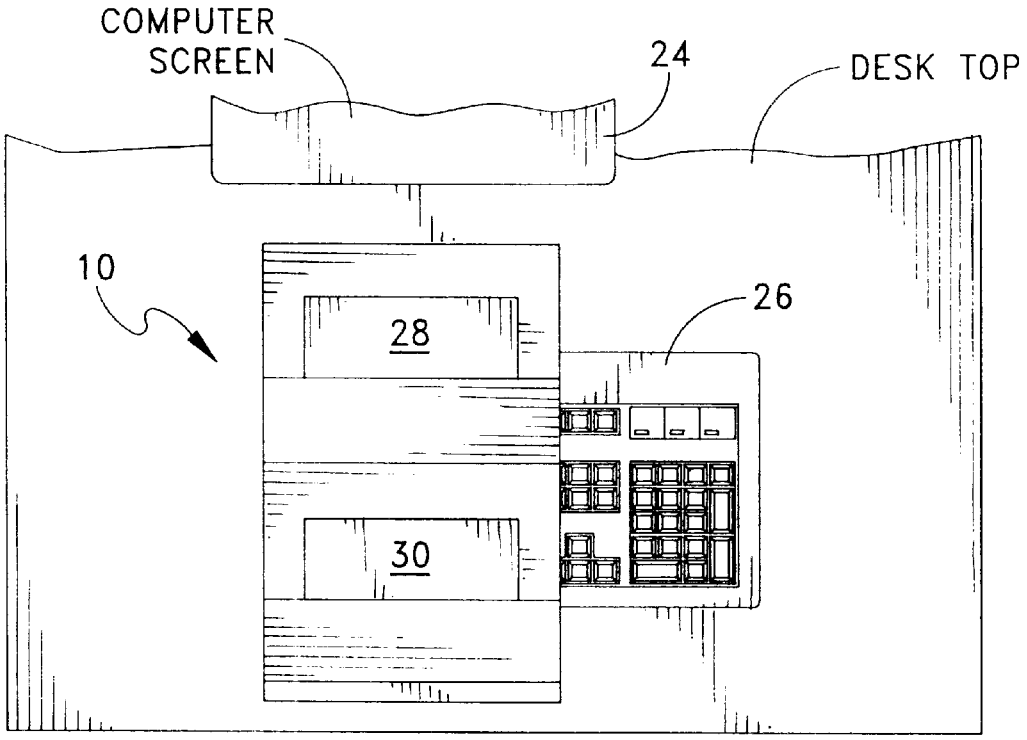
FIG. 6 is a top plan view of the system of FIG. 5.

The data document handling apparatus is shown in FIGS. 1–4 for the handling of checks to be processed with the apparatus formed of a thermomolded or thermoplastic hard polymer material with a closed rear wall, open adjacent sides and (optional) an open front to define a standard keyboard receiving space beneath the top W-shaped platform. FIGS. 5 and 6 illustrate the system with the keyboard beneath the platform in the open space, but the numerical section of the standard keyboard extending outwardly to the right from the open space beneath the platform to permit a user to use only the numerical section in the handling of the checks shown on the surface platform. The checks are shown with the front of the checks in view on the angular rear surface and the rear of the previous turned over previous check shown on the angular surface of the third platform from the rear with an illustrative view indicating the sequence of check turnover.

FIGS. 1–6 show a data document, e.g., check handling apparatus 10 of the invention injection-molded or thermoformed of a opaque or translucent acrylate sheet material having a base 12, a vertical side 14 and angular surfaces 16, 18, 20, and 22 and open at one end for the positioning of a keyboard 26 connected to a computer monitor 24 at least partially beneath the angular surfaces 16–22. As shown in FIG. 6 the right hand numerical portion of the standard keyboard extends outwardly for use to enter the data from the processed checks 28 (front of check) and 30 (rear of check) into the computer and for display on the computer screen 24.

Figure 7:
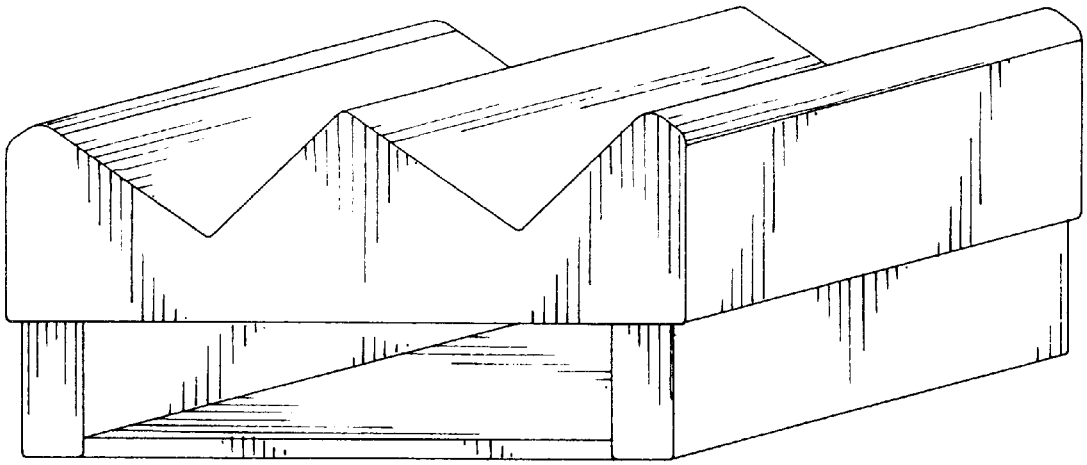
FIG. 7 is a perspective photographic view of another embodiment of the apparatus.
Figure 8:
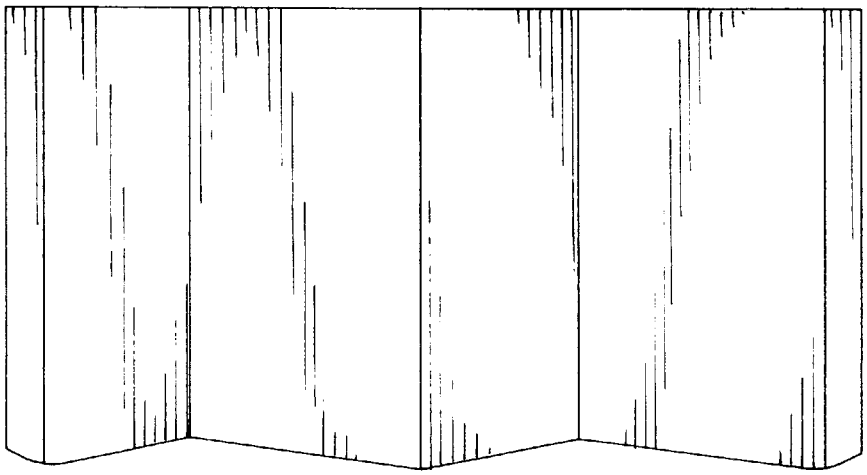
FIG. 8 is a top plan photographic view of the apparatus of FIG. 7.

FIGS. 7 and 8 are photographic representations of another embodiment made of solid wood with open sides for the positioning of the left or right-handed maneuvered position of the keyboard.

What is claimed is:

1. A data document handling apparatus for the entry of data on the face, or rear, or both of the document into a computer system for displaying on a monitor screen, which apparatus comprises:

a) a base with a generally vertical wall at one side, and with another opposite open side, and a top surface having a plurality of four continuous, connected, raised angular surfaces extending from the vertical wall toward said open side for the stacking of data documents on one angular surface to display the document face and another adjacent angular surface for a user turning over the document to display the document rear to a user; and b) the base characterized by an open space beneath the top surface, and said other open side, adapted to provide for the positioning of a portion of a computer keyboard beneath the top surface, and the extension of a section of the keyboard to extend for use beyond said open side, for data entry of information on the documents by a user into a computer.

2. The apparatus of claim 1 which comprises a continuous thermoformed sheet material with said base having a front, rear, and one and another said side, said generally vertical wall at said one side, and with the front and rear and other side open.

3. The apparatus of claim 1 wherein the angular surfaces extend at about 90 degree angles to each other.

4. The apparatus of claim 1 wherein the document face and the document rear are generally of the same angle and length and spaced apart by one angular surface.

5. In combination, the apparatus of claim 1 which includes a computer keyboard with alphabetic and numerical sections, and wherein one section extends beyond said other open side.

6. The combination of claim 5 which includes a computer data entry system with a monitor screen and the keyboard operatively connected to the computer system.

7. The combination of claim 5 which includes a plurality of stacked checks, as the documents, with numerical data from the checks to be entered through the keyboard onto the monitor screen.

* * * * *